United States Patent [19]

Lowenkron et al.

[11] 4,428,897

[45] Jan. 31, 1984

[54] PROCESS FOR PREPARING PARTICLE BOARD

[75] Inventors: Steven B. Lowenkron; Richard A. Prather, both of Houston; Howard R. Steele, Baytown, all of Tex.

[73] Assignee: The Upjohn Company, Kalamazoo, Mich.

[21] Appl. No.: 452,777

[22] Filed: Dec. 23, 1982

[51] Int. Cl.[3] ..... B28B 7/04

[52] U.S. Cl. ..... 264/109; 264/338

[58] Field of Search ..... 264/109, 338

[56] References Cited

U.S. PATENT DOCUMENTS

| | | | |
|---|---|---|---|
| 4,110,397 | 8/1978 | Wooler | 264/338 |
| 4,257,995 | 3/1981 | McLaughlin et al. | 264/122 |
| 4,257,996 | 3/1981 | Farrissey et al. | 264/122 |
| 4,258,169 | 3/1981 | Prather et al. | 528/72 |
| 4,352,696 | 10/1982 | Prather | 106/163 R |

FOREIGN PATENT DOCUMENTS

| | | |
|---|---|---|
| 2921689 | 11/1980 | Fed. Rep. of Germany . |
| 2921726 | 11/1980 | Fed. Rep. of Germany . |

*Primary Examiner*—James R. Hall

*Attorney, Agent, or Firm*—Denis A. Firth; John Kekich

[57] ABSTRACT

Particle boards are currently prepared by treating the particles (e.g. wood chips) with a binder comprising an organic polyisocyanate and, optionally, a release agent and then subjecting the treated particles to a molding process involving heat and pressure. The resulting particle board will generally release well from the caul plates of the press after forming. However, it has been found that the ease of release is enhanced, particularly where the wood particles in the board are derived from hardwood, by utilizing a metal selected from magnesium and zinc in the metallic surfaces of the caul plates or platens which come into contact with the particle board during the application of heat and pressure.

9 Claims, No Drawings

PROCESS FOR PREPARING PARTICLE BOARD

BACKGROUND OF THE INVENTION

1. Field of the Invention

This invention is concerned with a process for the preparation of particle board and is more particularly concerned with an improved process in which the metal plates, which come into contact with the particle boards during the forming process using an organic polyisocyanate as the binder, are fabricated from certain metals.

2. Description of the Prior Art

The use of organic polyisocyanates, alone or in admixture with an internal release agent, as the binder composition in the preparation of particle board is now well established in the art. U.S. Pat. No. 4,257,995/6, 4,258,169, and 4,352,696 describe the use of certain organic phosphates, thiophosphates, pyrophosphates and related phosphorus-containing compounds as internal release agents in such binder compositions. German Offenlegungsschrift 2,921,689 and 2,921,726 show the use of organic sulfonic acids and derivatives as internal release agents in similar organic polyisocyanate binder compositions. Processes have also been described in which the polyisocyanate is used as the binder composition and release agents are applied directly to the press plates utilized in preparing the particle boards; see, for example, U.S. Pat. No. 4,110,397 which shows applying a metallic soap to the surface of the caul plates prior to pressing.

The above types of binder compositions, comprising an organic polyisocyanate and, optionally, an internal release agent, are generally applied to the particles employed to form the particle board, either neat or in the form of an aqueous emulsion, prior to forming the particle board from the treated particles using heat and pressure. The organic polyisocyanate, and the internal release agent if one is used, can be admixed prior to application to the particles or, in a less preferred mode of operation, the two components of the binder composition can be applied separately to the particles.

After being treated with the binder composition, the particles (e.g. wood chips and other cellulosic or non-cellulosic material which is capable of being compressed and bound into the form of a board as discussed more fully hereafter) are then molded as boards using the action of heat and pressure. The necessary heat and pressure is generally applied utilizing a heavy duty press with heated metal platens. However, other forms of heat such as radio frequency radiation can be used. In many instances caul plates are employed and these are interposed between the platens of the press and the boards. In continuous operations, continuous belts may be used in place of individual caul plates. The caul plates or continuous belts are generally fabricated from aluminum, cold-rolled steel, hot rolled steel, or stainless steel. The press platens themselves are usually hot rolled steel.

Using the above compositions containing the aforesaid mold release agents or using polyisocyanate binders in combination with external release agents, it is found that the particle board, after being formed, will release readily from the surface of the caul plates, or from the platens if no caul plates are employed, without the need to apply any manual or mechanical force to effect separation of the board and caul plates or platens. Further, it is found that such release generally occurs readily throughout a prolonged production run of such particle boards involving a pressing cycle of approximately 5 minutes per board of ½" thickness. However, it is sometimes found, particularly in the case of caul plates or platens which have been fabricated from steel, that a deposit of binder composition can build up on the surface of the caul plates or platens, particularly on the periphery immediately surrounding the outer edges of the area of the metal surface which comes into contact with the particle board. This deposit of material results from slight leakage of binder composition from the mat during the pressing of the particle board. After prolonged operation of the caul plates or platens this buildup of residue, which residue tends to become degraded by heat as the production run progresses, can interfere with the ease with which the particle boards will release from the metal surface during the removal operation.

It has also been found that the ease with which the particle boards will release from the caul plates or platens when using polyisocyanate binders in association with internal or external release agents can vary to a significant extent according to the nature of the particles being used. Illustratively, boards which are prepared using some hardwood chips such as those derived from oak show a significantly greater tendency to adhere to the platens than do boards prepared from other chips such as those derived from pine and the like cellulosic materials.

We have now found that the ease of release of particle boards from the surface of the caul plates or platens which come into contact with the boards during the forming process, can be enhanced significantly by fabricating said plates or platens, or at least the surfaces thereof which come into contact with the boards, from magnesium or zinc. This finding not only helps to obviate the occasional difficulties described above, but can, in many cases, enable the level of release agent incorporated into the binder composition to be significantly reduced.

SUMMARY OF THE INVENTION

This invention comprises a process for the preparation of particle board wherein particles of material capable of being compacted are contacted with a polyisocyanate binder, optionally containing an internal release agent, and the treated particles are subsequently molded into boards by the application of heat and pressure utilizing metal caul plates or platens, characterized by the improvement which comprises employing as the metallic surfaces which come into contact with said particle boards during said application of heat and pressure a metal selected from the group consisting of magnesium and zinc.

DETAILED DESCRIPTION OF THE INVENTION

The improved process of the invention is carried out in accordance with the procedures which are well-described in, for example, the aforesaid U.S. Pat. No. 4,257,995/6 whose disclosures are specifically incorporated herein by reference, the only significant departure from such procedures being the use of magnesium or zinc in the metallic surfaces which come into contact with the particle board during the forming process.

In the majority of particle board manufacturing operations metallic plates, known as caul plates, are interposed between the platens of the press and the surface of the mat which is being formed into a particle board by application of heat and pressure. In some cases, however, caul plates are not used and the surface of the platens of the press comes into direct contact with the mat. The critical feature of the present invention is that the metallic surfaces which come into contact with the particle board during this pressing operation, whether they be the surface of the caul plates, or in the absence of the use of caul plates, the surfaces of the platens of the press, are fabricated from magnesium or zinc. Where reference is made hereafter to providing such metallic surfaces of magnesium or zinc, it is to be understood that the surfaces in question are those of the caul plates and not those of the platens of the press unless the pressing operation is to be carried out in the absence of caul plates in which latter case it is the surfaces of the platens of the press to which reference is being made.

The provision of the metallic surfaces in accordance with the invention can be achieved in a variety of different ways. Thus, the entire member, be it caul plate or platen, whose surface comes into contact with the particle board during the forming process, can be fabricated from magnesium or zinc. Alternatively, the member in question can be fabricated from another metal such as iron, aluminum, cold-rolled steel, hot-rolled steel, stainless steel, and the like and a thin layer of magnesium or zinc can be applied thereto so that the said layer forms the whole of the surface which will come into contact with the particle board. In the case of zinc the said thin layer can be produced readily by a galvanizing process using conventional techniques. In the case of magnesium the thin layer is prefabricated and then secured to the appropriate surface of the caul plate or platen, as the case may be, using any conventional means such as screws, rivets, bolts and the like.

As is well recognized in the art, primary magnesium lacks sufficient strength in its elemental state to be used as a structural metal and is generally employed as an alloy with minor amounts of one or more metals such as aluminum, manganese, thorium, rare-earth metals, lithium, tin, zinc and zirconium. A comprehensive description of such alloys, methods for their preparation, and terminology used to designate them is given in Encyclopedia of Chemical Technology, Kirk-Othmer, Third Edition, Vol. 14, pp. 592–611, John Wiley and Sons, New York, 1981. It is to be understood that reference to use of magnesium in fabrication of the caul plates or platens or the surfaces thereof in accordance with the present invention encompasses the use of elemental magnesium and the aforesaid alloys.

Subject to the modification of the caul plates or platens of the press in the manner described above the procedure employed in the preparation of particle boards in accordance with the process of the invention is essentially that employed previously in the art when using a polyisocyanate binder alone or in combination with an internal or external release agent; see the art cited above and the description set forth in the various examples given below.

The particles which are employed in making boards in accordance with the invention comprise particles of cellulosic and like material capable of being compacted and bonded into the form of boards. Typical such materials are wood particles derived from lumber manufacturing waste such as planer shavings, veneer chips, and the like. Particles of other cellulosic material such as shredded paper, pulp or vegetable fibers such as corn stalks, straw, bagasse and the like, and of non-cellulosic materials such as scrap polyurethane, polyisocyanurate and the like polymer foams can also be used. Inorganic materials such as hydrated alumina, gypsum, chopped mineral fibers and the like can also be employed either alone or in combination with any of the above cellulosic or non-cellulosic materials.

As stated previously, the utilization of caul plates or platens which have been modified in accordance with the invention gives rise to a number of advantages compared with the use of plates or platens hitherto used in the art of making particle boards using polyisocyanate binders. For example, the use of the modified plates of the present invention enables one to achieve significantly better release for a larger number of pressings when hardwood chips are being used as the starting material for the boards. Further, the amount of internal release agent which is required to be incorporated in the polyisocyanate binder or the amount of external release agent utilized, can be reduced significantly when the modified plates or platens are employed in accordance with the invention. Since the release agent contributes to the total cost of the use of the polyisocyanate binder, any reduction in the level of the release agent represents an improvement in the economics of formation of the particle board. Indeed it has been found that use of the modified plates or platens in accordance with the invention enables particle board to be made from certain types of furnish such as Ponderosa pine discs without the need to use any release agent at all.

While the above description has been given chiefly in terms of batch type operations, it will be obvious to one skilled in the art that the invention can also be applied to continuous forming operations in which continuous metal belts are used in the forming process in place of individual caul plates. The surfaces of the said belts which come into contact with the particle board during the forming of the latter can be modified in any of the ways described above for the individual caul plates or platens.

The following example describes the manner and process of making and using the invention and sets forth the best mode contemplated by the inventors of carrying out the invention but is not to be construed as limiting.

Example 1

A series of wood particle boards was prepared using two different furnishes with three types of caul plates. The various caul plates were fabricated from aluminum (Alloy 6061: $\frac{1}{8}$ inch thickness), magnesium (AZ31B Alloy: $\frac{1}{8}$ inch thickness) and cold-rolled steel (1/16 inch thickness) which had been galvanized on all surfaces. Immediately prior to initiating a test, both the upper and lower cauls were pre-treated with a thin film of commercial tridecyl acid phosphate. The two furnishes were long leaf pine ($\frac{3}{8}$ inch hammer milled; density 36 pcf) and a blend of mixed Southern hardwood strands (about 1 mm$\times$10 mm$\times$60 mm to 1.5 mm$\times$2.0 mm$\times$20 mm; density 41–43 pcf). The binder resin was polymethylene polyphenyl polyisocyanate (eq. wt.=133: functionality 2.8) containing 7 percent w/w of a pyrophosphate derived from commercial lauryl acid phosphate.

The standard procedure used in preparing the particle boards in all cases was as follows.

A batch of furnish (1000 g.) was sprayed with a total of 30 g. of the binder resin. The spraying operation was accomplished by placing the furnish in a rotating blender drum and rotating the drum while applying the resin to the tumbling furnish with an internal mix spray tip. A final board density of 42 pcf was obtained by taking a portion of the sprayed furnish (210 g. Southern hardwood or 235 g. long leaf pine) and forming the furnish into a mat on a lower caul plate (dimensions 8 inch×12 inch) to be used in the pressing process. A plywood forming frame (6 inch×8.5 inch) was used to prepare the mat and was removed after the mat was prepared. The lower caul carrying the mat was placed on the lower platen of a small Dake press and two $\frac{5}{8}$ inch thick spacer bars placed along the two longer opposing edges of the lower caul plate. The second of the two caul plates (dimensions 10 inch×14 inch) was firmly affixed to the upper platen of the press in a hanging caul arrangement. Both platens of the press were preheated to 350° F. and maintained thereat throughout the pressing operation. The lower platen was then rapidly raised such that the mat touched the upper caul plate. Pressure was then applied to bring the upper caul plate into contact with the spacer bars (45 seconds required) and the pressure was maintained for 2.5 minutes after contact was made with the spacer bars. At the end of this period the pressure was released, the particle board removed from the press, and the lower caul removed and made ready for mat formation. In the case of the use of each set of caul plates with each furnish the above operation was repeated, without any intermediate treatment of the surface of the caul plates, until evidence of sticking of the caul plates to the particle board was first observed in the demolding process. The operation, using the same set of caul plates and furnish, was then continued until the point was reached at which the particle board could no longer be separated from the caul plates in the demolding process. The following table records the number of particle boards which were prepared, using a given combination of caul plates and furnish, before sticking was first observed ("Partial") and until separation of the board from the plates was not possible ("Failure").

| Metal of caul plates | Furnish | No. of boards | |
|---|---|---|---|
| | | Partial | Failure |
| Aluminum | Long leaf pine | 15 | 48 |
| | Southern hardwood | 5 | 8 |
| Galvanized steel | Long leaf pine | 10 | 56 |
| | Southern hardwood | 6 | 13 |
| Magnesium | Long leaf pine | >57 | — |
| | Southern hardwood | >59 | — |

It will be seen from the above results that the performance of the magnesium plates was markedly superior to that of the aluminum plates with both types of furnish. With the magnesium plates there was no sign of even partial sticking after pressing 57 plates using the long leaf pine furnish and 59 plates using the Southern hardwoods, whereas the aluminum plates showed partial sticking after 15 and 5 plates, respectively, with the same furnishes, and total failure after 48 and 8 plates, respectively. The use of the galvanized steel also showed improvement over the aluminum plates but to a lesser degree than the magnesium plates.

What is claimed is:

1. In a process for the preparation of particle board wherein particles of material capable of being compacted are contacted with a polyisocyanate binder and the treated particles are subsequently molded into boards by the application of heat and pressure utilizing metal caul plates or platens, the improvement which comprises employing, as the metallic surfaces which come into contact with said particle board during said application of heat and pressure, a metal selected from the group consisting of magnesium and zinc.

2. A process according to claim 1 wherein the caul plates, which come into contact with said particle board during said application of heat and pressure, are fabricated from magnesium.

3. A process according to claim 1 wherein the caul plates, which come into contact with said particle board during said application of heat and pressure, are fabricated from a metal selected from the class consisting of aluminum, cold-rolled, hot-rolled and stainless steels said caul plates being provided with a layer of a second metal selected from the group consisting of magnesium and zinc which layer completely covers the surface of said plates which comes into contact with said particle board during said application of heat and pressure.

4. A process according to claim 3 wherein said caul plates are fabricated from steel which has been galvanized on the surfaces thereof which come into contact with said particle board.

5. A process according to claim 1 wherein said polyisocyanate binder also comprises an internal release agent.

6. A process according to claim 1 wherein a release agent is applied to the metallic surfaces which come into contact with said particle board during said application of heat and pressure.

7. In a process for the preparation of particle board wherein particles of material capable of being compacted are contacted with a polyisocyanate binder and the treated particles are subsequently molded into boards by the application of heat and pressure utilizing metal caul plates or platens, the improvement which comprises employing caul plates fabricated from magnesium in said application of heat and pressure.

8. A process according to claim 7 wherein said polyisocyanate binder also comprises an internal release agent.

9. A process according to claim 7 wherein a release agent is applied to the surfaces of said caul plates which come into contact with said particle board during said application of heat and pressure.

* * * * *